US006298945B1

(12) United States Patent
Anders et al.

(10) Patent No.: US 6,298,945 B1
(45) Date of Patent: Oct. 9, 2001

(54) FIREFIGHTERS' REMOTE ROOF VENTING APPARATUS

(75) Inventors: Bruce Anders, Bethel, AK (US); Irving Anders, Cottage Grove, WI (US)

(73) Assignee: Jilbe Enterprises, L.L.C., Cottage Grove, WI (US)

( * ) Notice: Subject to any disclaimer, the term of this patent is extended or adjusted under 35 U.S.C. 154(b) by 0 days.

(21) Appl. No.: 09/553,350

(22) Filed: Apr. 21, 2000

(51) Int. Cl.[7] ..... E06C 1/00

(52) U.S. Cl. ..... 182/68.1; 182/66.1; 182/102; 169/70

(58) Field of Search ..... 182/66, 67, 68.1, 182/101, 102, 103, 129, 142; 254/17, 131; 169/54, 70; 239/271, 222.19

(56) References Cited

U.S. PATENT DOCUMENTS

| | | | | |
|---|---|---|---|---|
| 14,891 | * | 5/1856 | Amringe | 182/67.1 X |
| 197,324 | * | 11/1877 | Boynton | 182/66.1 |
| 202,263 | * | 4/1878 | James | 182/68.1 |
| 283,654 | * | 8/1883 | Peteler | 182/68.1 |
| 440,827 | * | 11/1890 | Hoffman | 182/66.1 X |
| 589,244 | * | 8/1897 | Cantore | 182/101 |
| 2,312,833 | * | 3/1943 | Graham | 182/102 |
| 2,459,621 | * | 1/1949 | Cobb | 182/102 |
| 4,183,423 | * | 1/1980 | Lewis | 182/103 |
| 4,396,093 | * | 8/1983 | Zimmerman | 182/208 |
| 4,697,740 | * | 10/1987 | Ivy | 239/271 |
| 4,802,535 | * | 2/1989 | Bakke | 169/70 |
| 4,930,599 | * | 6/1990 | Simms, Sr. | 182/103 |
| 5,409,067 | * | 4/1995 | Esposito et al. | 169/62 |
| 5,540,284 | * | 7/1996 | Esposito et al. | 169/62 |
| 5,738,185 | * | 4/1998 | Sears | 182/102 |
| 5,832,755 | * | 11/1998 | Crilly | 70/58 |
| 5,913,367 | * | 6/1999 | Hampton | 160/70 |
| 6,193,170 | * | 2/2001 | Fitzgerald | 239/271 |

* cited by examiner

*Primary Examiner*—Bruce A. Lev

(57) ABSTRACT

A roof venting apparatus is mounted to a firefighting vehicle's aerial extension ladder, where a semi-cylindrical, double-pointed lance is dropped and raised onto and through the roof of a burning structure as many times as necessary to properly vent the burning building. The lance is dropped and raised by a free-spooling, electric braking winch, which is mounted to an anchor board securely hooked onto the bottom rungs of a fire truck's aerial extension ladder, and which is operated by a fire fighter on the ground who mans a toggle control panel welded onto the lower anchor board. The winch cable extends up the length of the extended aerial ladder, through a series of stabilizing, free-wheeling idler wheels mounted to another removable anchor board screwed onto the top rungs of the truck's extension ladder. The lance, if hollow, is transported to the scene of the fire empty, where it can be filled with water with the fire hose, to establish the necessary dropping weight. After its use, it is emptied through the drain hole at the base of the lance when the fire has been controlled and the lance is ready to be transported back to the station.

13 Claims, 4 Drawing Sheets

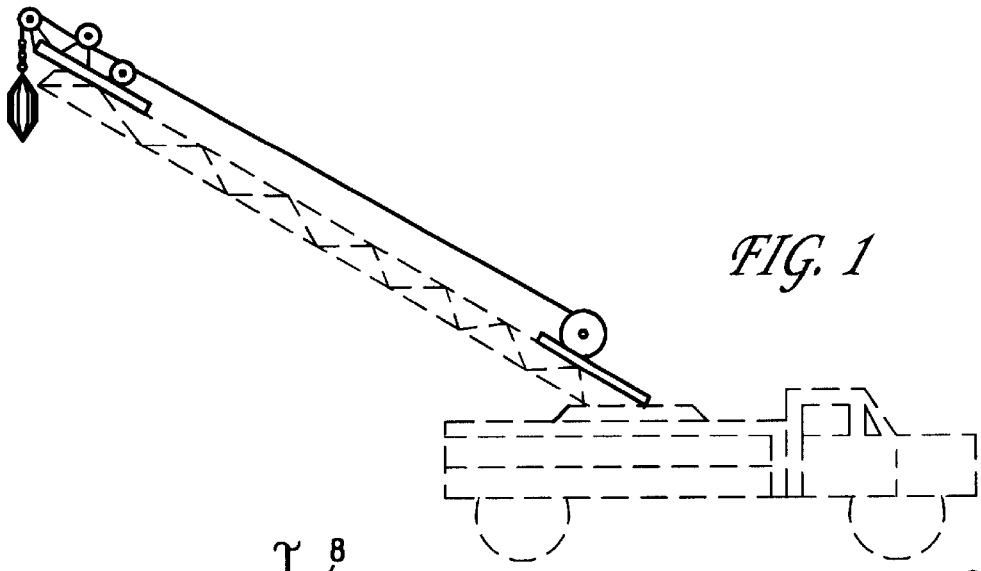
FIG. 1
FIG. 2
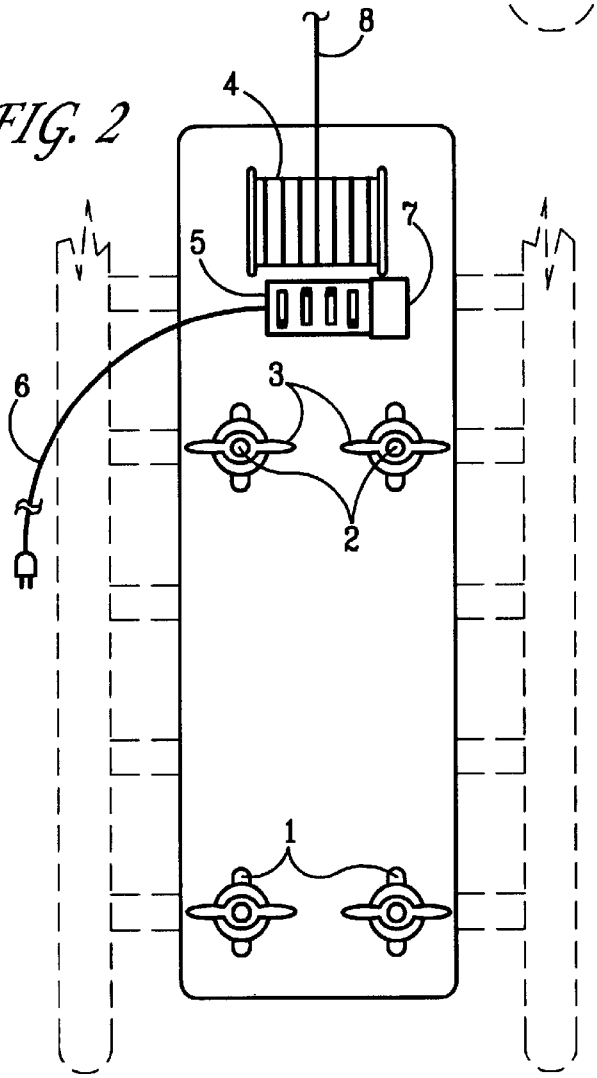
FIG. 3
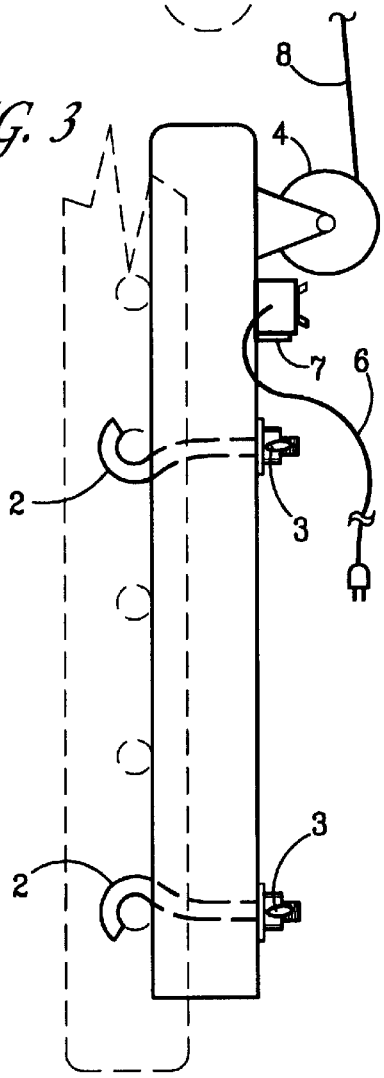

FIREFIGHTERS' REMOTE ROOF VENTING APPARATUS

BACKGROUND OF THE INVENTION

1. Field of the Invention

The present invention relates to the craft of firefighting generally, and more specifically, to a combination of devices comprising an apparatus that can be mounted to conventional firefighting vehicles to quickly and powerfully vent the roofs of burning structures from a remote location, by punching through the roof using a pointed steel cylindrical object, filled with water for added weight, and dropped through the roof using the conventional extension ladder system from a standard firefighting vehicle.

2. Description of the Prior Art

Fighting fires is inherently dangerous, due to the hazards of the flames themselves, as well as the heat, smoke and other noxious gases that are generated as byproducts of burning materials. One of the most hazardous facets of fighting a structural fire is the task of one or more firefighters having to climb atop and puncture the roof of the burning structure in order to vent the heat and gases within the building. Venting the gases and heat within the burning building is a critical step in containing, venting and combating the fire within. During a structural fire, heavy concentrations of heat, gases and smoke build up within the building, causing great risk of smoke inhalation, gas poisoning, and explosion to the non-evacuated inhabitants of the structure and to the firefighters themselves, not to mention damage to the property within the burning structure. Firefighter(s) presently, as they have in the past, accomplish this important roof venting procedure by exceedingly dangerous and primitive means. Specifically, one or more firefighters must mount, or be placed upon, the roof itself of the burning structure, and use strenuous manual techniques, such as with chainsaws, axes, picks and the like, to lance a hole in the roof of sufficient diameter to vent the gases, heat and smoke. U.S. Pat. No. 5,165,659, at p. 1, column 1, adequately describes the traditionally accepted means of venting such roofs through manual means:

> Presently firemen labor strenuously with axes to open the roof of a burning building by chopping through the roof material. Frequently the roof material is made up of 4×8 panels of plywood covered with other layers of material covered with tar paper or shingles. Chopping through such roof panels with axes can take as long as three to five minutes to open up a sufficiently large vent opening.

Or, the assignees' U.S. Pat. No. 4,531,613 discloses a means by which the ladder on which the firefighter climbs atop the roof has "spread apart upper rails to provide clearance and working space for them to chop an opening in the roof of a burning house."

The assignee's U.S. Pat. No. 4,068,417 discloses a means of solving the problem by which buildings already have a vent pre-cut into the roof, such that in case of a fire, the vent can be opened remotely to save the firefighters the task of punching the roof materials themselves at the scene of the fire. But this invention is "preferably for use in high rise building," rather than pitched residential structures as is the instant invention. Further, unlike U.S. Pat. No. 4,068,417, the instant invention does not require the astronomical expense and effort that would be required for hundreds of millions of structure-owners nationwide to retrofit the structures to include a pre-vent system.

All prior art, such as the assignee's U.S. Pat. No. 5,165,659, and the assignee's U.S. Pat. No. 4,531,613, attempt to lessen the danger and difficulty of rooftop firefighters having to puncture the roofs of burning buildings. But none address the seminal problem with the roof venting process, namely the fact that the firefighter him- or herself must be physically present on the roof top to operate the roof venting equipment. Regardless of the type of tools and methods that are disclosed by art such as that described in U.S. Pat. No. 5,165,659 and U.S. Pat. No. 4,531,613, all such devices and methods require the firefighters themselves to physically lance the roofing material from a position on the roof. The roof venting procedure is typically considered the most thrilling and perilous of the whole firefighting process [see, e.g., *Fire Engineering Magazine*, October 1996, Vol. 149, No. 10 (cover photograph taken by Robert E. Kirsch, showing an Englewood, N.J. firefighter atop the roof of a burning pitched private structure engulfed in smoke and flames, as he attempts to lance a hole through the roof using a chainsaw)]. There are several serious problems with this traditional method of venting the roofs of burning structures through manual means.

First and most importantly, manual venting techniques place the firefighter in great personal danger. The task of venting the roof of a burning building is uniformly viewed by firefighters as the most dangerous and unpredictable facet of combating a fire. The roof area is typically the most dangerous and unstable area of a burning structure, as great quantities of heat, gases, flames and smoke all push upward, seeking to break through the inner surface of the roof beneath the firefighter's feet. As the structural fire progresses, the flames and effects therefrom render the roof of the burning structure increasingly and unpredictably dangerous and unstable to the firefighter. Even mounting the roof can be dangerous, as the firefighter climbs up and onto the burning, unstable structure. Where possible, i.e., at earlier stages of the fire's incineration of the structure, the firefighter can sometimes ascend the roof using ladders affixed to a portion of the roof not engulfed in flames. Alternatively, the firefighter must climb dangerous structures to mount the roof, or must be placed onto the roof using aerial ladders from the firefighting truck. Then, as the firefighter mans tools and devices to physically hack away at several layers of dense roofing materials to penetrate the roof, sharp shards of roofing plywood, papers, nails and screws can themselves become dangerous projectiles, harming either the firefighter himself, or the critically important protective clothing or self contained breathing apparatus he wears. Finally, if/when the firefighter achieves his very purpose for being on the roof, i.e., by successfully lancing a hole through the roof material, heat, smoke, flames and gases can burst through the hole, often explosively, causing potentially serious injury or death to the firefighter.

Thus, the process whereby a firefighter attempts to vent the roof of a burning building subjects the firefighter to several deadly perils, including: injury while climbing insecure structures to reach the rooftop, smoke and gas inhalation, burning, heat injury, injury from breaking through the roof, injury from sharp protruding roofing debris, and explosion of gases beneath the roof surface.

Second, it can take a significant amount of time to vent the roof through the traditional manual techniques, even utilizing devices and methods such as that described in U.S. Pat. No. 5,165,659. To safely place a live firefighter on the roof of the burning building often requires precise, complex and time consuming techniques. As described above, the firefighter must either ascend the roof using ladders affixed to a presumably unburned portion of the structure, or must climb dangerous portions of the structure itself, or be placed onto the roof using aerial ladders from the firefighting truck. Thereafter, as described above, the firefighter must actually lance the roof using tools and devices to physically hack through several layers of dense, sharp roofing materials. All of these protracted and unpredictable steps of the traditional roof venting process cost precious seconds, during which valuable property is lost, noxious conditions intensify, and the fire itself progresses to less manageable stages and proportions.

Third, the firefighter's valiant, strenuous and dangerous efforts may not even produce the most effective vent(s), due to the limitations of the firefighter's time and physical strength. Because the buildup of gases and smoke within the structure may require a large volume escape passageway from the building, or because the buildup does not necessarily occur evenly within the structure, it may be necessary to create a large holes, and/or numerous holes to provide the most efficient and effective vent(s), while still attempting to minimize unnecessary property damage. A firefighter, using manual techniques, is severely limited by both the strength a human can apply to the arduous task of punching through a portion of a roof designed to withstand great physical forces, and by the small window of time within which he or she can safely remain on the roof of the burning building. For these reasons, a firefighter lancing a single hole in a roof by manual means can provide insufficient area to provide a timely and effective vent, can be placed in the wrong portion of the roof, or can be insufficient/ineffective in a situation requiring several holes in a particularly compartmentalized structure.

SUMMARY OF THE INVENTION

The Remote Roof Venting Apparatus is mounted to the firefighting vehicle's aerial extension ladder. Thereafter, in a preferred embodiment, a hollow, water-weighted, semi-cylindrical, double-pointed lance is repeatedly dropped and raised onto and through the roof of a burning structure as many times as necessary to properly vent the burning building. The lance is dropped and raised by a free-spooling, electric braking winch, which is mounted to a removable anchor board securely attached via a mechanical hooking mechanism onto the bottom rungs of the truck's extension ladder, and which is operated by a fire fighter on the ground who mans a toggle control panel welded onto the lower anchor board. The winch cable extends up the length of the extended aerial ladder, and through a series of stabilizing, free-wheeling idler wheels mounted to another removable anchor board attached to the top rungs of the truck's extension ladder. The empty lance is easily transported to the scene of the fire, where it can be filled with water, using the fire hose, to achieve an adequate dropping weight. It is emptied through the drain hole at the base of the lance when the fire has been controlled and the lance is ready to be transported back to the station. In alternate embodiments, the lance is very thick plate or a solid steel monolith, in which case the assembly is quicker.

It is an object of this invention to provide devices and methods to enable firefighters to rapidly vent the roof of a burning building from a location remote from the rooftop, to protect the health and safety of the firefighter(s), and the occupants of the structure.

It is a further object of this invention to provide devices and methods to enable firefighters to vent the roof of a burning building as quickly as possible, minimizing lost property, the intensification of noxious conditions, and the progression of the fire to less manageable proportions.

It is a further object of this invention to provide devices and methods to enable a firefighting team to vent a burning building in a manner that creates a sufficient number of holes and/or hole(s) of sufficient diameters to provide the most efficient and effective vent(s) for that particular fire.

It is a further object of this invention to provide devices and methods to enable a firefighting team to vent a burning building in a manner that minimizes unnecessary property damage to the burning structure and the personal property therein.

It is a further object of this invention to enable fire fighters to be able to assemble the invention at the scene of the fire quickly, and with minimal manual labor.

It is a further object of this invention to enable a firefighting team to vent a burning building achieving the above objects using devices and methods that can be adapted and fitted to existing, conventional firefighting equipment and vehicles.

BRIEF DESCRIPTION OF THE DRAWINGS

A detailed description of one preferred embodiment of the Firefighters' Remote Roof Venting Apparatus is hereafter described with specific reference being made to the drawings in which:

FIG. 1 is a side perspective view of the Firefighters' Remote Roof Venting Apparatus assembled on a conventional aerial extension ladder fire truck ready for deployment.

FIG. 2 is a top elevational view of the bottom mounted anchor board.

FIG. 3 is a side elevational view of the bottom mounted anchor board.

DESCRIPTION OF THE PREFERRED EMBODIMENT

Figure 4:
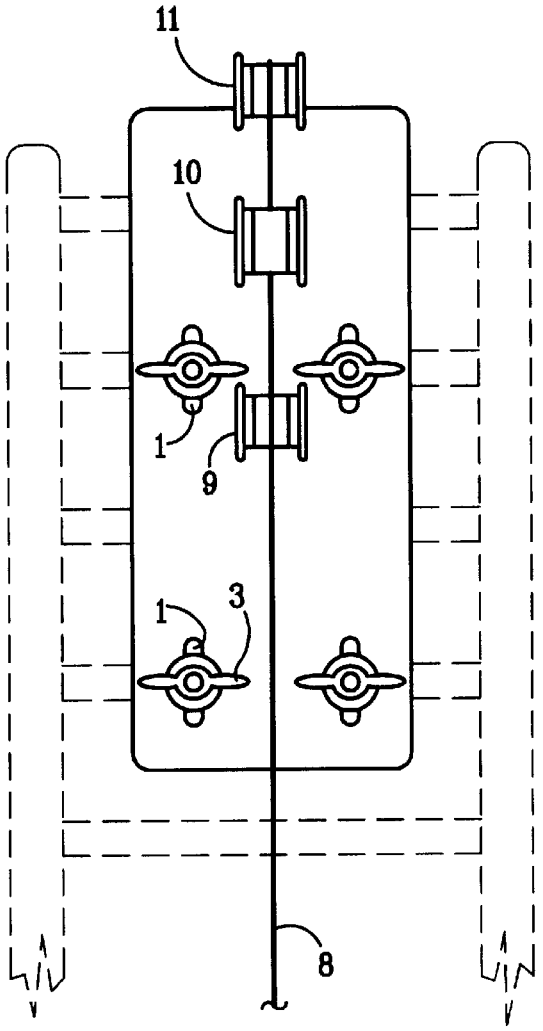
FIG. 4 is a top elevational view of the top mounted anchor board.

The bottom mounted anchor board (FIGS. 2 and 3) is an adjustable, detachable mounting board that is designed to be fitted to existing conventional fire truck extension ladders. As described in the prior art, "[f]irefighting vehicles such as ladder trucks include extendible aerial ladders whereby the ladders may be raised and extended in excess of 100 feet, as may be required in fighting fires in multi-story buildings, or conducting rescues therefrom." U.S. Pat. No. 5,368,317, Col. 1. Most fire truck extension aerial ladders are constructed in common and conventional dimensions, and the instant invention can be fitted onto this conventional design, or can be adjusted to fit non-conventional dimensions. The bottom mounted anchor board itself is constructed of appropriately fire-resistant materials such as aluminum, steel, or fiberglass. Its width is slightly narrower that the width of the ladder. The board has four vertical slots [1], through which four adjustable threaded rung hooks [2] pass. The hooked end of each threaded rung hook passes through the vertical slot and hooks around the appropriate rung of the ladder behind the board. Each hook is cinched tightly and securely around the appropriate rung by snugly tightening the wing nut and washer [3] down onto the threaded end of the hook. In this way, the mounting board can be rigidly attached to the ladder, but can be removed and adjusted as needed. At least two rows of vertical slots and threaded rung hooks must be used, such that the hooks can hook the rungs in opposite directions, preventing the bottom mounted anchor board from moving up or down along the ladder. A winch [4] and a winch control unit [5] are welded to the bottom mounted anchor board. Also attached is either a winch control unit conventional power line and plug [6] or a battery unit [7].

The winch can be a standard 12/24/110/220 volt electric winch, with power in/out design, horsepower sufficient to produce 2,000–8,000 lbs. haul strength, with 25%–75% excess burst strength. In an alternate embodiment, the winch can be a hydraulic winch, which can be directly tied into the hydraulic systems used by many models of newer fire trucks. The winch should have free spooling capacity, and a manual clutch mechanism to allow the winch operator to arrest the free spooling winch line at the appropriate moment, locking the line in place by an automatic load-holding brake. The winch could use a worm gear, spur gear, or planetary gear system as long as the transfer efficiency is such that the clutch mechanism allows for free spooling, manual braking, and load-holding. The winch cable [8] should be 3/16 to 5/8 inch galvanized or stainless steel aircraft-quality cable. The length of the winch cable should be at least twice the length of the aerial ladder when fully extended, in order to utilize the maximum extension distance of the ladder when venting roofs where the truck cannot be parked immediately adjacent to the burning structure.

The winch control unit houses a switching device to control and operate the electric winch, discussed below. Using the winch control unit, the human operator of the roof venter apparatus can operate and control the roof venting process from the safety of the base of the truck. To enable the operator to accomplish this, the winch control unit has switch controls that enable the operator remotely to accomplish the following operations: (1) retract the winch cable, in order to raise the cable and the lance to the drop position; (2) unwind the winch cable, in order to slowly lower the lance to the ground for emptying after the roof venting operation has been completed; (3) free-wheel release the cable, to drop the lance in free fall onto the roof once it has been raised to drop position; and (4) a stop brake, to arrest the fall of the lance once it has punctured the roof, then (5) raise the winch cable for another drop, if necessary. A simple toggle or button switch design can be used for each operation. In a preferred embodiment, the winch would have a variable speed retraction capability, to allow the operator to raise the winch relatively slowly or swiftly. In an alternative embodiment, a variable speed retraction feature on the winch can be omitted.

The winch can derive its power from, in a preferred embodiment, the truck itself, through the truck's battery and electrical system. Fire trucks generally have external power outlets for powering commonly used external firefighting equipment, such as lights and electric water delivery systems. The winch on the bottom mounted anchor board can therefore receive its power through the standard 12/24/110/220 volt winch control unit conventional power line and plug [6], which could easily plug into the external outlet board of the truck, using an appropriate adapter, if necessary. In another embodiment, the winch's power source could derive from an independent unit, e.g. a battery unit [7], attached to the bottom mounted anchor board, and could thus be independent of the fire truck. In either embodiment, the winch and the winch control unit are affixed directly to the bottom mounted anchor board. If the power source is independent (battery), then that unit is attached to the bottom mounted anchor board; if the power source derives from the fire truck, then the winch will have a power cord to plug into the fire truck's external outlet. If the winch utilizes the power source from the truck, during winch operation, the truck's motor should be running, with the alternator running, to minimize battery drain and maximize winch power and speed.

Like the bottom mounted anchor board, the top mounted anchor board (FIGS. 4 and 5) is an adjustable, detachable mounting board that is designed to be fitted to a conventional fire truck extension ladder. As can be seen from FIGS. 4 and 5, the top mounted anchor board is similar to the bottom mounted anchor board, in that its width is slightly narrower that the width of the ladder, it has four vertical slots [1], through which four adjustable threaded rung hooks [2] pass, snugly tightened with four wing nuts and washers [3]. The top mounted anchor board can be affixed to the ladder before the ladder is extended. In this way, the board can be attached on the ground where the conditions are safe and controlled, before the tip of the ladder is extended over the heat and smoke of the fire.

Attached to the top mounted anchor board is the lower idler wheel and bracket [9], the middle idler wheel and bracket [10] and the upper idler wheel and bracket [11]. The winch cable extends from the winch, located below on the lower mounted anchor board, and weaves through the three idler wheels: it passes over the top of the lower idler wheel, underneath the middle idler wheel, and over the top of the upper idler wheel. This procedure can be performed on the ground at the location where the truck has parked, after the top mounted anchor board is attached to the ladder. Thus, the cable can be threaded through the idler wheels, and when the extension ladder is extended, the cable is pulled from the winch wind.

The idler wheels are free wheeling in both directions. Thus, the lower idler wheel allows the cable to pass freely over the surface of the extension ladder, the middle idler wheel holds the cable securely down onto the lower and upper idler wheels, and the upper wheel carries the primary load of the cable and the weighted lance beneath. The idler wheels, particularly the upper wheel, must be centered on the width of the ladder, to prevent a twisting torque on the ladder as the top point bears the full weight of the lance hanging straight down. The three wheels are grooved to prevent lateral drift of the cable. The three idler wheels, axles and brackets are constructed of stainless steel, or similarly strong, fire-resistant materials, such as titanium, since they must be strong enough to withstand loads in excess of the burst strength of the winch, particularly the upper idler wheel.

Figure 9:
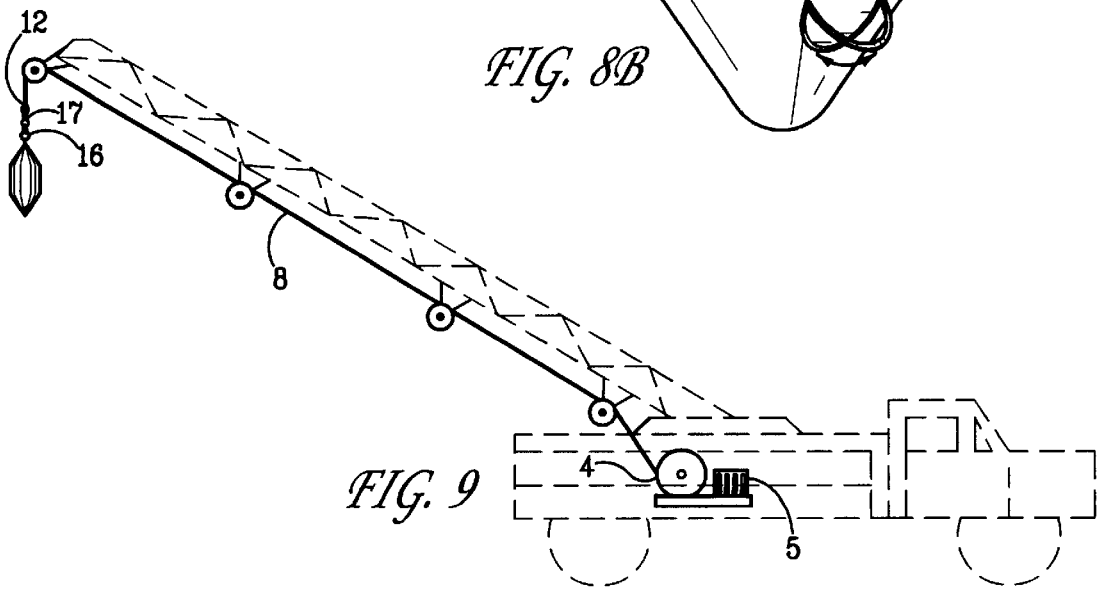
FIG. 9 depicts a side view of the apparatus attached to a fire truck.

Note that, in another embodiment, the lower and upper mounted anchor boards could be affixed, using the same hook technique, on the underside of the ladder. In this embodiment, the top surface of the ladder could still be used, if necessary, by firefighters needing to climb the ladder without being blocked by the boards. The underside-affixed embodiment is most successfully used where the system is integrally affixed to/within the fire truck, as explained below in FIG. 9.

Figure 5:
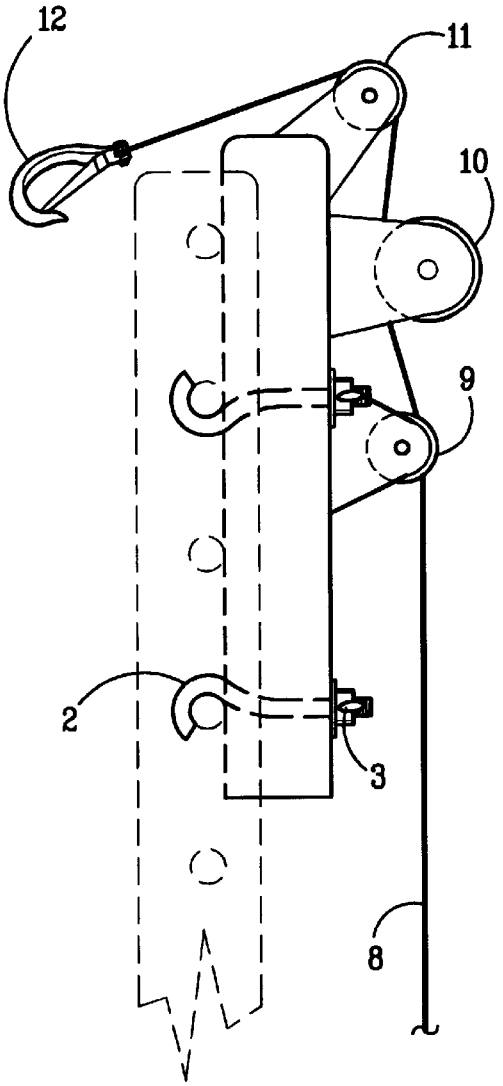
FIG. 5 is a side elevational view of the top mounted anchor board.

Also pictured in FIG. 5 is the clevis hook [12]. This hook holds the lance cable, described below. Note that the clevis hook design prevents the lance cable's connector loop, discussed below, from disconnecting from the winch cable before, during, and after lance impacts onto the target roof. Also note that, at the scene of the fire, the winch line must be threaded through the carriage wheels, and the clevis hook must be small enough to fit through the carriage wheel space. If the carriage wheel space must be so small that a sufficiently strong clevis hook would not fit through, then, in another embodiment, the clevis hook would be removeable, such that the line could thread through the carriage wheels without the hook, and the hook could be attached using a loop-to-loop attaching system, or a clamping device, after the line has passed through.

Figure 6:
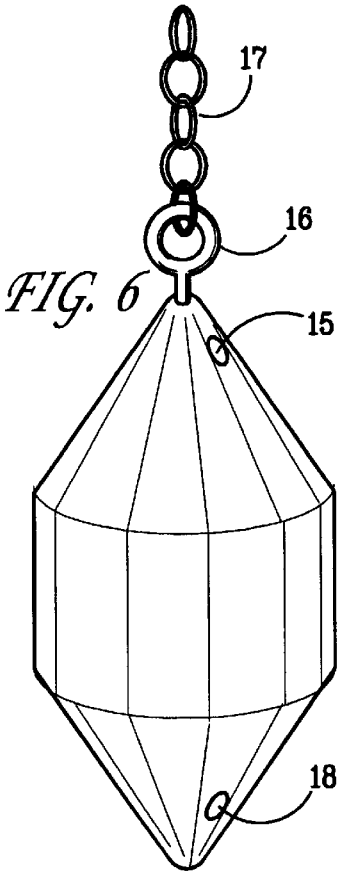
FIGS. 6, 6A and 6B depict a side elevational view of the water-weighted lance.
Figure 7:
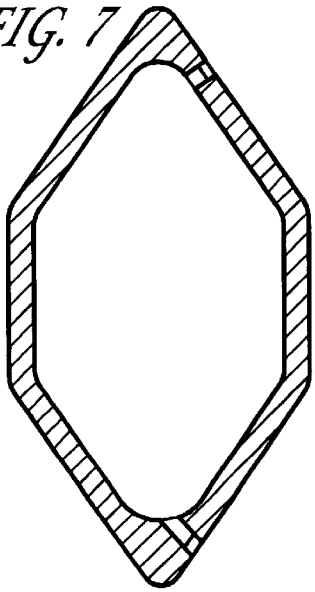
FIGS. 7, 7A and 7B depict a side sectional view of the water-weighted lance.
Figure 8A:
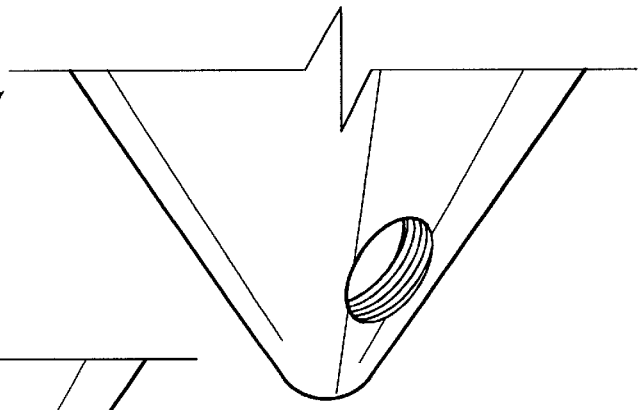
FIGS. 8, 8A, and 8B depict a side sectional views of the lance drain hole.
Figure 8:
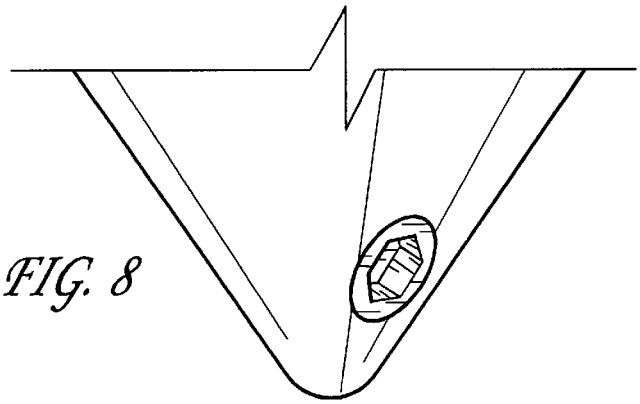

FIGS. 6, 7 and 8 depict the lance in a preferred embodiment, where the lance is hollow, water-weighted, cylindrical in the middle, with a cone-shaped top third, and inverted cone-shaped lower third. It is apparent how the lower inverted cone forms the point that will actually puncture the roof when the lance is dropped. The middle portion of the lance, when the lance is filled with water, provides the necessary bulk and weight for the puncture. The top portion of the lance is cone-shaped, so that after the lance is dropped and punctures the roof, it can be easily withdrawn without getting stuck within the jagged roofing materials that could be pointing downward into the hole after the puncture.

Figure 6A:
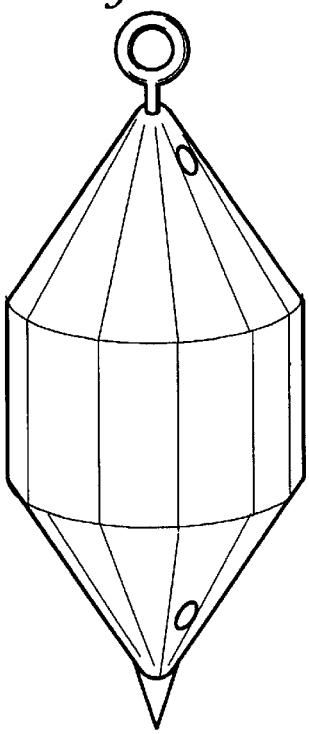

In an alternate embodiment, the lance can have a more elongated and more sharply pointed tip. This "spiked lance" embodiment, depicted in FIG. 6*a*, would more narrowly focus the energy from the lance's downward blow. This design would be achieved by welding a short spike to the tip of the conical lower third of the lance. Using this sharper alternate design, the lance will more effectively puncture denser/thicker or more steeply sloped roofs, or under circumstances where the lance's dropping distance is reduced due, for example, to the burning structure being located at an elevation relatively high to the parked fire truck, reducing the distance above the structure that the maximum extension of the ladder can reach. The spiked tip can be firmly welded onto the bottom tip of the lance. Of course, the longer and more oblong the point on the bottom of the lance is, the more difficult it is to achieve direct vertical strikes, where the vertical medial axis of the lance approaches perpendicular to the longitudinal baseline of the structure. In other words, the more that the shape of the lance approaches a pointed cylinder, the greater the risk of blows glancing off the diagonal surface of the roof.

Figure 6B:
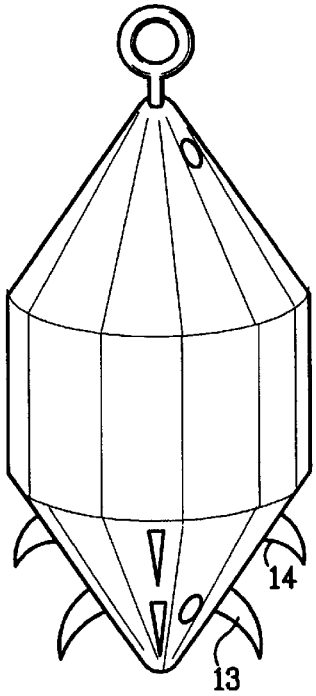

A third embodiment of the lance shape is claimed, in order to account for the "glancing blow" situation, which in situations such as that where the burning structure's roof has a severe pitch/gradient. This embodiment, pictured in FIG. 6*b*, depicts the "taloned lance" design, which employs four slightly curved spikes welded onto the bottom portion of the lance. The talons can be located in a cluster talon configuration [13] on the lower tip, or in the higher spread talon configuration [ 14]. The advantages of the cluster configuration versus the spread talon configuration are obvious upon examination of the diagram: the cluster configuration provides are more narrowly focused striking point while sacrificing some effect with severely pitched roofs, and visa versa with spread talon configuration. It should be noted that a fire department could possess several different lances, and the roof type and circumstances would drive which model is hooked to the cable and used to vent a particular roof type.

The walls of the hollow lance are constructed of suitably strong, non-brittle, fire- and heat-resistant, heavy material, such as stainless steel or titanium. As depicted in FIG. 7, The walls are of a suitable thickness, between one and three inches. Since the lance is hollow, it is light enough when empty to be handled and moved manually by the firefighters before, at and after the scene of the fire. At the scene of the fire, the firefighters fill the lance with water to add weight. The lance is thus mobile when it is empty, and is sufficiently heavy to puncture a roof at the scene of the fire after it has been filled with water.

Figure 7A:
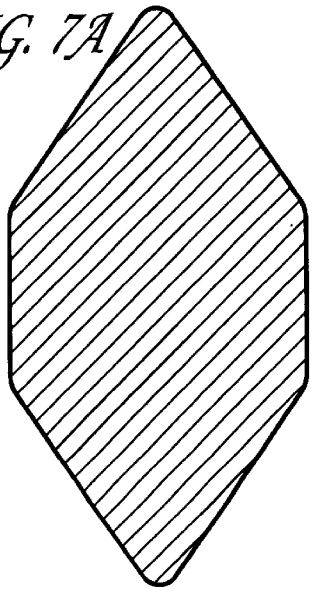

In an alternative embodiment, depicted in FIG. 7*a*, the lance is not hollow. Rather, the lance is solid stainless steel, which would have several advantages over the hollow lance, including a far heavier striking force, and saving time in having to fill the lance at the scene of the fire. The disadvantages are that the solid lance is considerably heavier for storage, transport, and deployment, particularly in positioning the lance by hand beneath the aerial ladder manually, and that the lance would place greater stress on the winch, cable, and mounting plates.

Figure 7B:
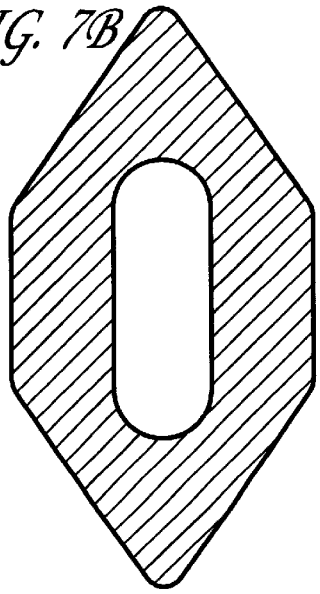

An intermediate embodiment is pictured in FIG. 7*b*. In that embodiment, the lance is constructed of heavy plated stainless steel. This plated steel lance significantly heavier than the hollow lance, but is not so heavy and difficult to maneuver as the solid lance.

The size of the lance is largely dependent upon the strength of the extension ladder, the capabilities of the fire truck, and the power of the winch. But the lance should be as heavy as the equipment can safely handle, while still being light enough when the lance is empty to be manageably stored, transported and assembled by the fire fighters. Depending upon the lance's design and use, the lance should be of a diameter anywhere between 6 and 36 inches, and a height between 2 and 6 feet.

The water is added to the lance through the fill hole [15] at the very top of the lance. The diameter of the fill hole, in a preferred embodiment, should slightly exceed that of the nozzle of a standard fire hose, so that a fire hose can be used to fill the lance. Alternatively, an adapter can be used. The fill hole is located at the uppermost point of the lance so that the hollow space inside the lance can be filled with water as completely as possible. This will prevent "sloshing" inside the lance, which would decrease the balance, stability, density and solidity of the lance when dropped. The lance should be attached to the winch cable and positioned on the ground beneath the end of the aerial ladder when it is empty and maneuverable. After the lance is attached to the winch cable and positioned, it can be filled with water.

Attached to the top point of the lance is the lance attachment hook [16]. The attachment hook can be integral to the body of the lance, or can be a separate piece that is screwed into the top point of the lance. Attached to the lance attachment hook is the lance connector chain [17]. The connector chain is made of galvanized or stainless steel, and connects the lance to the clevis hook when the firefighters are ready to connect the lance to the winch cable. The length of the connector chain need only be one to two feet, sufficient to provide a strong, detachable, flexible connection link between the winch cable's clevis hook and the lance attachment hook. The length of the chain should be kept as short as effectively possible so that, when the lance is in "drop" position (i.e., where the extension ladder is at full extension, and the winch cable has been retracted to the point where the clevis hook has been pulled to the upper idler wheel), the lance will have the maximum distance to fall, maximizing its puncturing power.

At the bottom of the lance is the lance drain hole [18]. The drain hole is used to empty the lance after the fire has been extinguished and the roof venting apparatus is ready for disassembly and transportation back to the fire station.

Figure 8B:
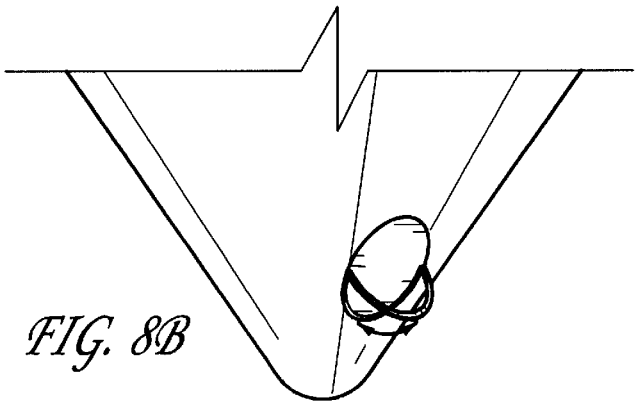

Both the fill and drain holes are plugged with a stainless steel fill/drain hole plug, depicted in FIGS. 8, 8A and 8B. This plug is designed to be removed by the firefighters when the using an industrial wrench, screwdriver or other device, when the lance is ready to be drained after use. When the lance has been emptied, the drain plug can be screwed back into place in the lance drain hole, ready for the next time the lance must filled with water. The plug can be, in one embodiment (FIG. 8), hexagonal, and thereby removed with a wrench. Alternatively, a retractable handle fill/drain hole plug design can be used. (FIG. 8B). In this design, the plug has a semi-ring steel looped piece, which can be recessed into a grooved on the plug when seated, and when popped outward on small hinges on its points, can be more easily grasped and screwed/unscrewed.

In a preferred embodiment, when the plug is in place in the lance drain hole, the surface of the plug is roughly flush with the surface of the surrounding area of the lance, to make the surface of the lower portion of lance smooth, minimizing drag and damage to the plug as the lance penetrates the roofing materials during a drop.

The functioning of the Firefighters' Remote Roof Venting Apparatus is as follows. At the scene of the fire, the firefighters attach the lower mounted anchor board to the bottom of the aerial ladder, and activate the winch power source by one of the two means described above. The upper mounted anchor board is then affixed to the top rungs of the of the extension ladder, while the extension ladder is not yet extended. The winch cable is woven through the idler wheels on the upper mounted anchor board, with the clevis hook hanging down. The lance is then filled with water, using the fire hose, and the last link of the lance connector chain is connected to the clevis hook. The aerial ladder is then extended to maximum extension. Note that, while the ladder is being extended, the weighted lance remains on the ground, and the winch is in free spool. In this way, the winch cable can be extended the length of the ladder without a firefighter having to manually attach the lance to the upper point of the ladder. When the ladder has reached full extension, then the winch operator retracts the winch cable, to bring the lance up to the "drop" position. The uppermost tip of the extension ladder can then be swung around to the appropriate location such that the lance is positioned directly above the point of the roof of the burning structure that must be punctured.

It is appreciated that various modifications to the inventive concepts may be apparent to those skilled in the arts without departing from the spirit and scope of the invention. For example, the entire system can be designed such that it is integral to the fire truck. [FIG. 9].

In such an embodiment, the bottom mounted anchor board would be unnecessary, as the winch [4] and winch control unit [5] are integral to the fire truck itself, mounted inside the vehicle's chassis, and powered by the vehicle's electrical system, or by its hydraulic system, if the winch is a hydraulic winch. The winch characteristics are the same as those described above, as are the winch cable [8], the clevis hook [12], the lance connector chain [17], the lance attachment hook [16], and the various embodiments of the lance. However, the idler wheels in this embodiment are on the underside of the ladder, and are attached, through welding (if metal ladder), or screwed (if wooden ladder), permanently onto the ladder itself, such that the winch cable passes on top of the wheels. The upper idler wheel again carries the brunt of the torque from the winch cable, but a position underneath the ladder rather than on top.

In this embodiment, minimal assembly is required at the scene of the fire, as no anchor boards need to be affixed to the ladder. Rather, the firefighters need only extend the winch cable from the winch in the truck, thread the carriage wheels, and hang the lance. Of course many municipalities and firefighting units are fiscally constrained, and would have to purchase a new fire truck with the system built in.

What is claimed is:

1. A remote roof venting apparatus comprising:

an extendible ladder having rungs;

a fire-resistant lower mounting board detachably attached to a lower most portion of the extendible ladder, the lower mounting board including vertical slots, steel threaded hooks passing through the vertical slots and removably attached to the rungs, and nuts and washers placed on the ends of the threaded hooks;

a winch welded onto the lower mounting board, the winch including a galvanized steel cable, an automatic brake, an electric cord and plug, retract capabilities, unwind capabilities, free-spooling capabilities, and a control unit including switching devices for operating the winch;

a fire-resistant upper mounting board detachably attached to an upper most portion of the extendible ladder, the upper mounting board including vertical slots, steel threaded hooks passing through the vertical slots and removably attached to the rungs, nuts and washers placed on the ends of the threaded hooks, and a plurality free-wheeling, grooved, fire-resistant idler wheels and brackets;

a steel, non-brittle, fire-resistant, hollow lance including a cylindrical middle portion, a cone-shaped top portion, an inverted cone-shaped lower portion, a fill hole next to an upper tip of the lance, a drain hole next to a lower tip of the lance, and a stainless steel, slotted hole plug removably dispose in each of the fill hole and drain hole;

and a metallic, closed-loop attachment hook attached to a top point of the lance, the attachment hook comprising a clevis hook and a short, metallic connector chain extending from the clevis hook and attached to an end of the winch cable.

2. The apparatus as defined in claim 1, wherein the winch is an electric winch.

3. The apparatus as defined in claim 1, wherein the winch is a hydraulic winch.

4. The apparatus as defined in claim 1, wherein the winch has a variable speed retraction capability.

5. The apparatus as defined in claim 1, wherein the winch further includes a battery power source affixed to the lower mounting board.

6. The apparatus as defined in claim 1, wherein the number of free-wheeling idler wheels upon the upper mounting board is between two and four.

7. The apparatus as defined in claim 1, wherein the hollow lance includes walls having a thickness between one-half and three inches.

8. The apparatus as defined in claim 1, wherein the hollow lance has a diameter between six and thirty six inches, and a height between two and six feet.

9. The apparatus as defined in claim 1, wherein the hollow lance is formed from a group of material including stainless steel and titanium.

10. The apparatus as defined in claim 1, wherein the hollow lance includes a steel spike welded onto a bottom tip of the cone-shaped lower portion.

11. The apparatus as defined in claim 1, wherein the hollow lance includes between two and eight slightly curved spikes welded onto a bottom tip of the cone-shaped lower portion in a taloned-design.

12. The apparatus as defined in claim 11, wherein the spikes are welded onto the bottom tip of the lance just below the juncture line between the cylindrical middle portion and the cone-shaped lower portion.

13. The apparatus as defined in claim 1, wherein the each hole plug includes a semi-ring steel looped handle hinged thereon, and wherein the handles can be recessed into grooves in each respective plug.

* * * * *